US008648720B2

(12) United States Patent
Woods

(10) Patent No.: US 8,648,720 B2
(45) Date of Patent: Feb. 11, 2014

(54) HIGH SECURITY BURGLAR ALARM DEVICE

(75) Inventor: Randall Woods, Sun Lakes, AZ (US)

(73) Assignee: Magnasphere Corporation, Waukesha, WI (US)

( * ) Notice: Subject to any disclaimer, the term of this patent is extended or adjusted under 35 U.S.C. 154(b) by 317 days.

(21) Appl. No.: 13/292,495

(22) Filed: Nov. 9, 2011

(65) Prior Publication Data

US 2012/0112911 A1 May 10, 2012

Related U.S. Application Data

(60) Provisional application No. 61/456,611, filed on Nov. 10, 2010.

(51) Int. Cl.
*G08B 13/08* (2006.01)

(52) U.S. Cl.
USPC ..... 340/547; 200/61.52; 335/205; 335/206; 335/207

(58) Field of Classification Search
USPC ..... 200/61.45, 61.52, 61.93; 335/205–207
See application file for complete search history.

(56) References Cited

U.S. PATENT DOCUMENTS

| | | | | |
|---|---|---|---|---|
| 5,332,992 | A | 7/1994 | Woods | |
| 5,530,428 | A * | 6/1996 | Woods | 340/547 |
| 5,673,021 | A * | 9/1997 | Woods | 340/547 |
| 5,880,659 | A | 3/1999 | Woods | |
| 5,977,873 | A * | 11/1999 | Woods | 340/547 |
| 6,087,936 | A * | 7/2000 | Woods | 340/566 |
| 6,506,987 | B1 | 1/2003 | Woods | |
| 6,603,378 | B1 | 8/2003 | Collins | |
| 7,023,308 | B2 | 4/2006 | Woods | |
| 7,291,794 | B2 | 11/2007 | Woods | |
| 7,825,801 | B2 * | 11/2010 | Woods | 340/547 |
| 8,228,191 | B2 * | 7/2012 | Woods | 340/568.1 |
| 8,314,698 | B2 * | 11/2012 | Woods | 340/568.1 |

* cited by examiner

*Primary Examiner* — Brian Zimmerman
*Assistant Examiner* — An T Nguyen
(74) *Attorney, Agent, or Firm* — Hovey Williams LLP

(57) ABSTRACT

Improved, magnetic high security switch apparatus is provided for use in detecting relative movement between first and second members such as a door frame and door from a close position, wherein the members are proximal, and an open position, where the members are separated. The switch apparatus includes a magnetic shiftable ball switch assembly having an elongated housing and a shiftable ball therein, which traverses an oblique path of travel between respective switch states in response to relative movement between the first and second members. Preferably, the housing is oriented at an oblique angle relative to the horizontal in order to prevent defeat of the switch apparatus through use of an external defeat magnet.

18 Claims, 3 Drawing Sheets

HIGH SECURITY BURGLAR ALARM DEVICE

CROSS-RELATED APPLICATIONS

This application claims the benefit of Provisional Patent Application No. 61/456,611, filed Nov. 10, 2010, and incorporated herein by reference in its entirety.

BACKGROUND OF THE INVENTION

1. Field of the Invention

The present invention is broadly concerned with improved, high security switch apparatus, which can be used as a part of an alarm system responsive to unauthorized opening of a door or the like. More particularly, the invention is concerned with such apparatus which makes use of a ball-type magnetic switch assembly having an elongated housing and a magnetically shiftable ball therein. The ball traverses a path of travel between respective switch states which is oriented at an oblique angle relative to the horizontal, in order to prevent defeat of the alarm system through use of an external defeat magnet.

2. Description of the Prior Art

Prior art security alarm systems often make use of magnetic switches attached to doors and windows and integrated with the system for detecting unauthorized openings. One common type of magnetic switch used in these situations is a so-called reed switch. It has been found that reed switches are subject to unauthorized manipulation through use of an external magnet. Specifically, an intruder can hold a relatively strong magnet adjacent the reed switch which will then be operated (to either, open or close depending on the control scheme). With this accomplished, an intruder can open the door or window without triggering the alarm system.

A number of magnetic switches have been proposed in the past to overcome the inherent deficiencies of reed switches. U.S. Pat. Nos. 5,332,992, 5,530,428, 5,673,021, 5,880,659, 5,977,873, 6,506,987, 6,603,378, 7,023,308, 7,291,794, and 7,825,801 describe switches of this type. These switches typically include a pair of spaced apart switch elements with a shiftable body (e.g., a spherical ball) vertically movable within an upright housing between a first position where the ball is in simultaneous contact with both elements and a second position out of such simultaneous contact. An alarm circuit is operatively coupled with the switch elements so as to detect movement of the body. These switches represent a very significant advance in the art. The Magnasphere Corporation of Waukesha, Wis., has commercialized a series of magnetic switches of this type.

While magnetic ball switches of this type are greatly superior to reed switches, instances can arise when a very strong defeat magnet can be successfully used against alarm systems containing conventional magnetic ball switches. This may occur when the strong magnet is strategically placed so as to maintain the ball in its non-alarm switch state during the course of an illegal entry. There is accordingly a need in the art for an improved magnetic ball switch which makes it virtually impossible to defeat the switch using an external defeat magnet.

SUMMARY OF THE INVENTION

The present invention overcomes the problems outlined above, and provides high-security magnetic switch apparatus for detecting relative movement between first and second members from a close position wherein the members are proximal, and an open position where the members are separated. The apparatus broadly comprises a switch assembly for mounting on one of the members and including a housing configured and presenting a central axis and having first and second, spaced apart, electrically conductive switch elements, together with a shiftable, electrically conductive body within the housing and movable between a first switch state wherein the body is in simultaneous contact with the first and second switch elements, and a second switch state wherein the body is not in simultaneous contact with the first and second switch elements. The overall switch assembly also includes a biasing member proximal to the switch housing. The biasing member and the shiftable body of the switch are magnetically correlated such that when the first and second members are in the open position, the biasing member magnetically maintains the body in one of the switch states.

The overall apparatus also has an operating magnet configured for mounting on the other of the members. The operating magnet and the switch assembly are magnetically correlated such that when the first and second members are in the close position, the operating magnet magnetically maintains the body in the other of the switch states against the magnetic correlation between the body and the biasing means.

As used herein, "magnetically correlated" refers to the fact that the respective components of the switch apparatus are selected in terms of the material makeup thereof, size, location, and relative orientation so as to provide the requisite magnetic functionality for the components.

In order to increase the security of the switch apparatus, the switch assembly is oriented so that the movable body traverses a path of travel between the first and second switch states which is oblique relative to the horizontal, so that, if a defeat magnet is placed adjacent the switch assembly when the first and second members are in the close position, the defeat magnet will magnetically move the body to the one switch state notwithstanding the close position of the first and second members. In preferred forms, the housing is oriented with the central axis thereof at an oblique angle relative to the horizontal.

Preferably, the shiftable switch body is in the form of a spherical ball formed of magnetic material, whereas the biasing member is formed of a ferromagnetic material, such as steel. The switch assembly housing is oriented with the central axis thereof at an angle of from about 15-80° relative to the horizontal.

DETAILED DESCRIPTION OF THE PREFERRED EMBODIMENT

Embodiment of FIGS. 1-4

Figure 1:
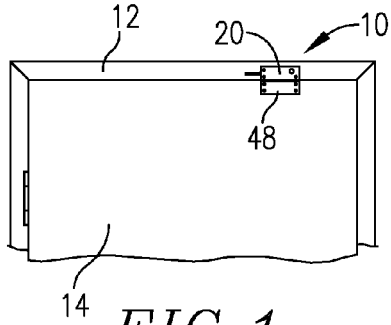
FIG. 1 illustrates a preferred magnetic switch apparatus in accordance with the invention, shown mounted and in use with a door frame and door.

Turning now to the drawings, a switch apparatus 10 is illustrated in FIG. 1, with components thereof mounted on a door frame 12 and door 14. Although not shown, it will be understood that the switch assembly 10 is operatively connected with an alarm system which will produce a discernable alarm in the event of a forced entry through door 14. The switch apparatus 10 broadly includes a switch assembly 16 normally mounted on frame 12, and a operating magnet assembly 18 mounted on door 14. As illustrated, when the door 14 is closed, the assemblies 16 and 18 are in close proximity, and when the door 14 is opened, the assemblies 16 and 18 are separated.

In more detail, the switch assembly 16 includes an outer enclosure 20 in the form of a generally rectangular box-like structure having inner and outer sidewalls 22, 24. As seen, the inner sidewall 22 abuts frame 12 and screws 26 are employed to secure the enclosure 20. The switch assembly 16 further includes a magnetic switch 28 and a biasing member 30 within enclosure 20. The switch 28 is in the form of a Magnasphere® magnetic switch and has an elongated metallic housing 32 with a non-conductive closure disk 34 at the lower end thereof. An elongated, rod-like first switch element 36 extends centrally through the closure disk 34 and is coupled with an external electrical lead 38. The conductive housing 32 serves as the second switch element, and an external lead 40 is coupled to the housing for this purpose.

A spherical magnetic body in the form of a spherical ball 42 is located within housing 32. The ball is shiftable within the housing 32 between a first switch state (see FIG. 2), wherein the ball 42 is in simultaneous electrical contact with the switch element 36 and housing 32 (in this instance, the closed switch state), and a second switch state (see FIG. 3), wherein the ball 42 is not in simultaneous contact with switch element 36 and housing 32 (in this instance, the open switch state).

The biasing member 30 comprises an elongated ferromagnetic (e.g., steel) component 44 of cylindrical shape. As illustrated, the component 44 is axially aligned with housing 32 and is spaced therefrom.

The switch 28 and biasing component 44 are magnetically correlated, such that when the 14 and frame 12 are in the open position (FIG. 3), the biasing component serves to magnetically shift and maintain the ball 42 in the second switch state wherein the ball 42 is out of simultaneous contact with the switch elements. In this embodiment, the ball 42 is formed of magnetic material, whereas the component 44 is ferromagnetic; of course, this arrangement could be reversed. The only important feature is that there be an appropriate magnetic correlation between the ball 42 and component 44.

In preferred manufacturing practice, the switch 28 and biasing component 44 are properly located within enclosure 20 and are tested for the appropriate magnetic correlation between the ball 42 and component 44. At this point, the enclosure 20 is filled with a potting material 45, such as epoxy, which surrounds the switch assembly 28 and component 44, permanently maintaining them in the desired orientation.

The overall switch apparatus 10 also includes an operating magnet 46 mounted to door frame 14. In detail, the magnet 46 is housed within a metallic enclosure 48 secured to door 14 by means of screws 50. The internal operating magnet 46 is magnetically correlated with the switch 28 so that, when the door 14 and frame 12 are in the close position, the operating magnet magnetically shifts and maintains the ball 42 in the other of the switch states (in this instance, the closed switch state) against the magnetic correlation between the ball 42 and biasing component 44. If desired, the enclosure 48 may be filled with potting material in the same manner as enclosure 20.

Figure 2:
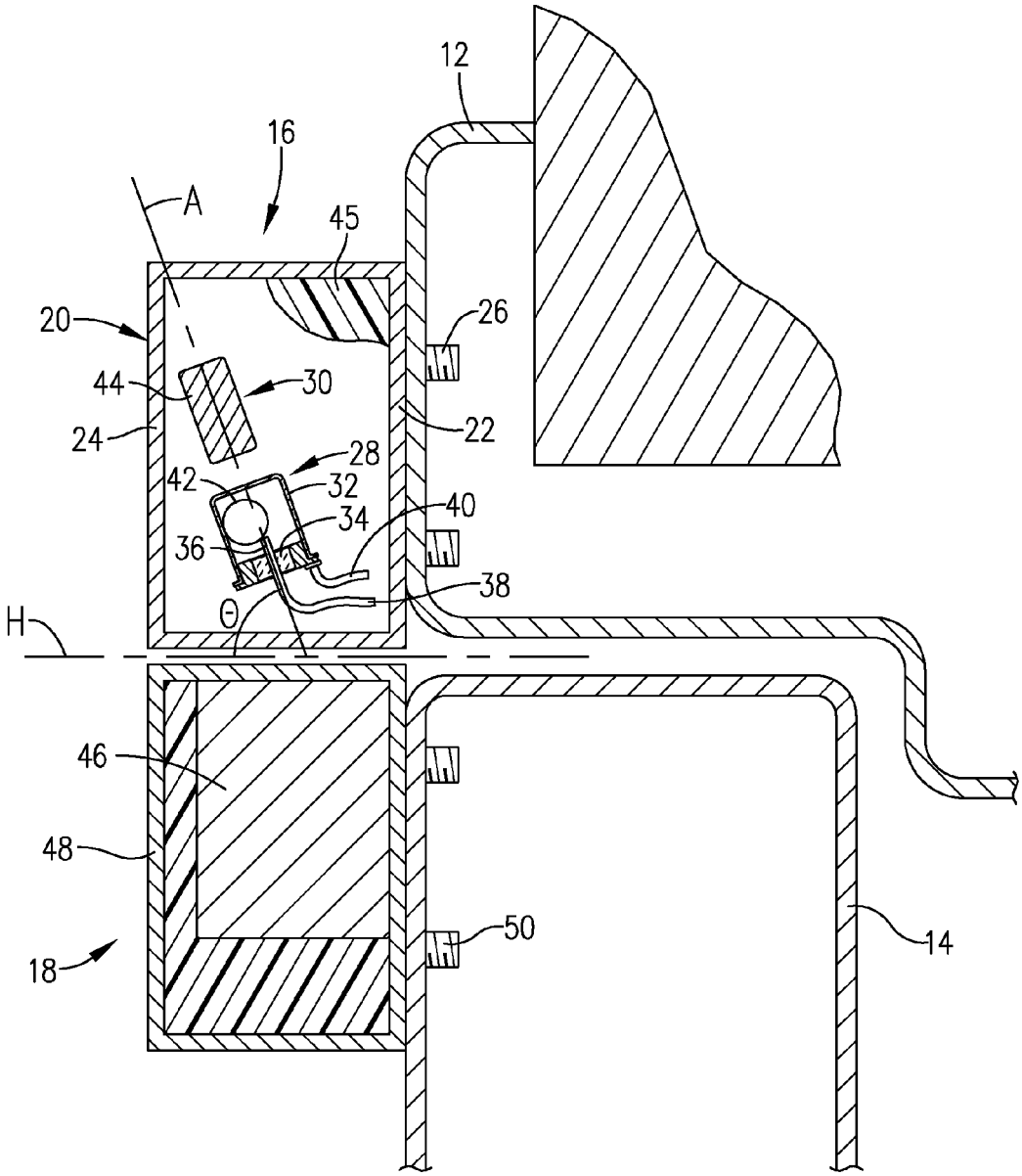
FIG. 2 is a fragmentary sectional view illustrating the components of the apparatus including a switch assembly, with the apparatus mounted on the door frame and door, and with the switch assembly in a first switch state.

Importantly, the housing 32 is oriented at an oblique angle within enclosure 20. Referring to FIG. 2, it will be observed that the central axis A of the housing 32 is at an oblique angle θ relative to the horizontal H. As used herein, an "oblique" angle is an acute or obtuse angle, but not a right angle, a straight angle, or a full angle. Preferably, the angle θ broadly ranges from about 15-80°, and, in this embodiment, from about 50-75°, relative to the horizontal. Also, the housing 32 is oriented such that an upwardly extending vector coincident with the central axis A may be resolved into orthogonal vector components, a an upwardly extending vertical component and a horizontal component directed away from the door frame 12. The inclination of housing 32 (and preferably the magnetic component 44 as well) makes it virtually impossible to defeat the switch apparatus 10 through the use of a defeat magnet (see FIG. 4), as explained below.

Figure 3:
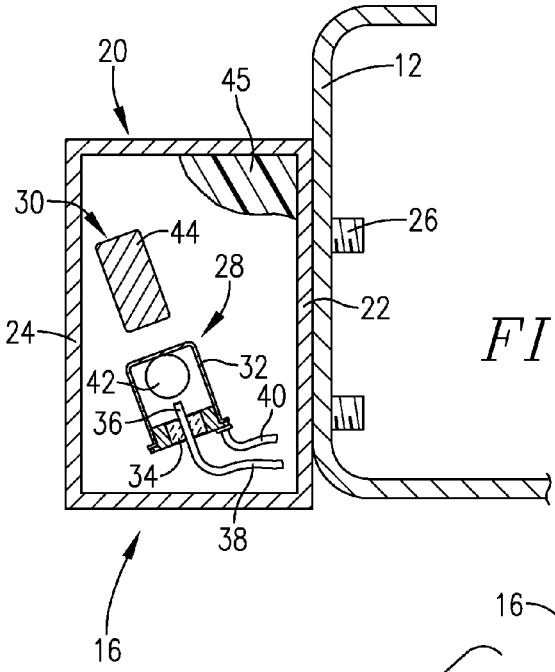
FIG. 3 is a view similar to that of FIG. 2, but depicting the switch assembly in a second switch state.

The operation of switch apparatus 10 can be readily understood from a sequential consideration of FIGS. 2 and 3. When the door 14 is closed, the operating magnet 46 comes into play to magnetically move and hold the ball 42 in the first switch state with the body 44 in simultaneous contact with rod-like first switch element 36 and the conductive housing 32 (FIG. 2). However, when the door 14 is in the open position (FIG. 3), the magnetic correlation between component 44 and ball 42 serves to magnetically move and maintain the ball 42 in the second switch state where the ball 42 is out of contact with the switch element 36. Of course, during normal business hours, the alarm coupled with the switch apparatus 10 is disarmed, and thus authorized opening of the door 14 does not trigger any alarm, even though the switch 28 changes states during opening and closing of door 14. During non-business hours, the alarm is armed so that if the door 14 is forced open in the course of an illegal entry, the movement of the ball 42 from the first switch state (FIG. 2), to the second switch state (FIG. 3) triggers the alarm.

Figure 4:
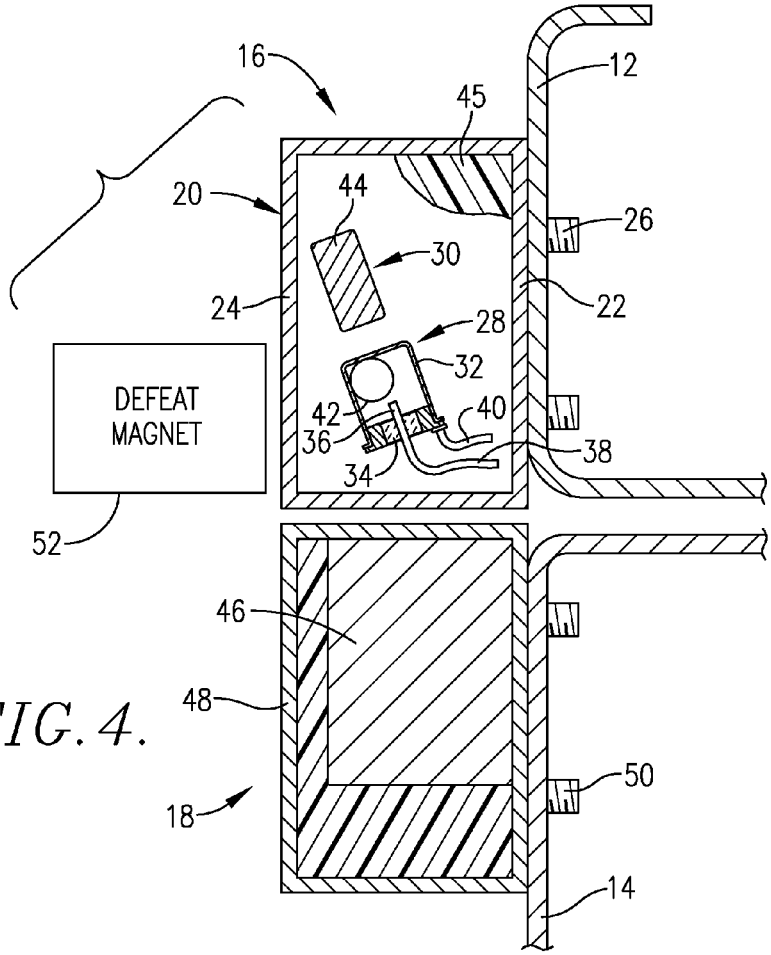
FIG. 4 is a view similar to that of FIG. 1, but depicting the alarm operation of the switch apparatus in the event that a defeat magnet is used in an attempted unauthorized opening of the door.

It will be appreciated that the ball 42 traverses a path of travel between switch states which is oblique relative to the horizontal. This is preferably accomplished by the inclination of housing 32 and, preferably, component 44. In such an orientation, it is virtually impossible to defeat the apparatus 10 through the use of a defeat magnet 52. That is, as seen in FIG. 4, if a defeat magnet 52 is placed adjacent the outer sidewall 24 of enclosure 20 while the system is armed, the defeat magnet itself will magnetically move ball 42 along an oblique path of travel to the second switch state, thereby triggering the alarm. This is to be contrasted with certain situations where a fully upright switch housing (i.e., oriented at a right angle to the horizontal H) could be defeated by a defeat magnet, i.e., the defeat magnet is of sufficient strength to maintain the ball 42 in the first switch state thereof, notwithstanding the opening of door 14. It will be appreciated that the inclination of the switch assembly 28 will necessarily cause ball movement to the second switch state in the presence of the defeat magnet 52; indeed, the stronger the defeat magnet, the more positively will it magnetically move the ball 42 to the alarm-giving second switch state.

Embodiments of FIGS. 5-8

Figure 5:
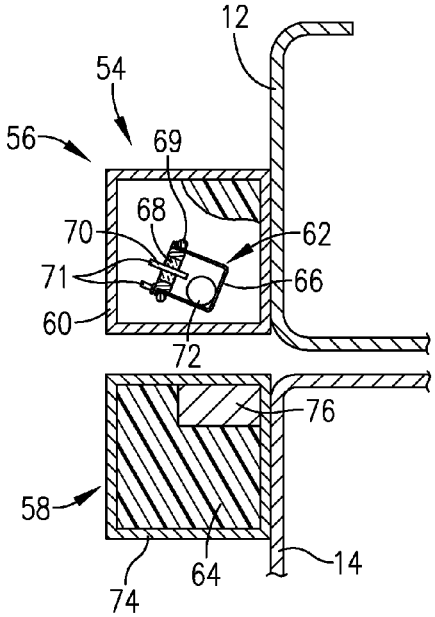
FIG. 5 is another switch apparatus embodiment in accordance with the invention, mounted on a door frame and door, with the switch assembly thereof in a switch open state.
Figure 7:
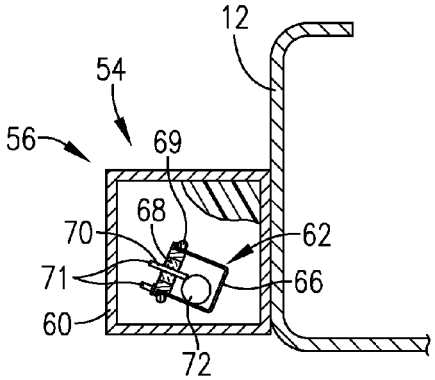
FIG. 7 is a view similar to that of FIG. 5, but illustrating the switch assembly in the switch state closed.
Figure 8:
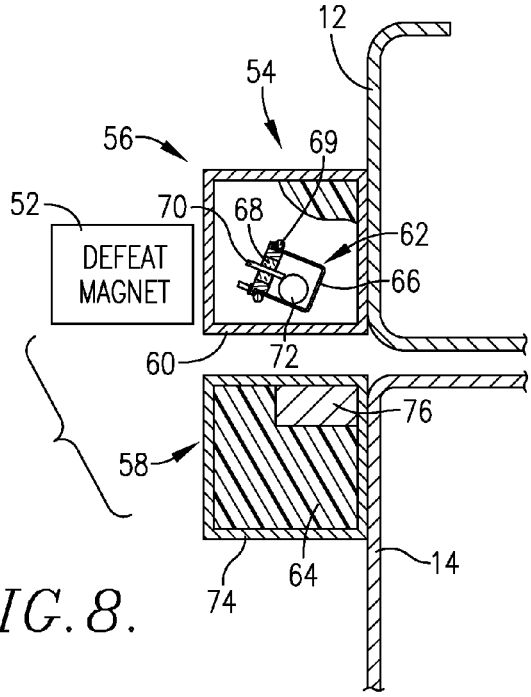
FIG. 8 is a view similar to that of FIG. 6, but depicting the alarm operation of the switch apparatus in the event that a defeat magnet is used in an attempted unauthorized opening of the door.

FIGS. 5, 7, and 8 illustrate another embodiment in accordance with the invention in the form of a switch apparatus 54, broadly including a switch assembly 56 and an operating magnet assembly 58 respectively secured to door frame 12 and door 14.

The assembly 56 includes an outer enclosure 60 with a switch 62 therein, and filled with potting material 64. The switch 62 includes an elongated, metallic, electrically conductive switch housing 66 with an endmost closure disk 68 formed of a non-conducting material, such as synthetic resin. An annular biasing element 69 formed of ferromagnetic material surrounds the upper end of housing 66 adjacent the disk 68. A rod-like, electrically conductive first switch element 70 extends centrally through the disk 68 and into the confines of housing 66, the latter serving as a second switch element. Leads 71 are operatively coupled to the switch element 70 and housing 66 to allow the switch assembly to be coupled to an alarm system (not shown). A magnetic spherical ball 72 is located within the housing 66 and is shiftable between a second state or open switch position (FIG. 5), wherein the ball 72 is out of contact with the switch element 70, and a first state or closed switch position (FIG. 7), where the ball 72 is in simultaneous contact with the first switch element 70 and metallic housing 66.

The operating magnet assembly 58 includes a housing 74 with an operating magnet 76 strategically located therein. Again, the housing 74 is filled with potting material 64.

The operation of switch apparatus 54 is substantially identical to that previously described with respect to apparatus 10, except that the switch states are reversed. That is, when the door 14 is closed (FIG. 5), the operating magnet 76 serves to shift and maintain the ball 72 in the second switch state corresponding to the switch open position. When the door 14 is opened, the biasing element 69 serves to magnetically move and maintain the ball in the first switch state corresponding to the switch closed position (FIG. 7). The anti-defeat function of the switch apparatus 56 is also identical to that described above, in that the defeat magnet 52 serves to move the ball 72 to an alarm-giving first switch state, wherein the ball 72 is in simultaneous contact with switch element 70 and housing 66. In this embodiment, the central axis of housing 66 is at an angle of from about 15-60°.

Figure 6:
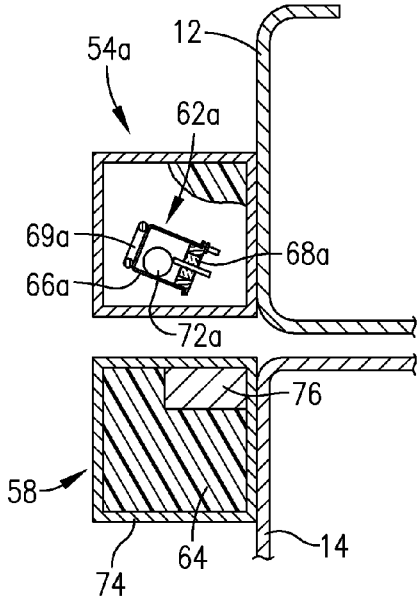
FIG. 6 is a still further switch apparatus embodiment in accordance with the invention, mounted on a door frame and door, with the switch assembly thereof in a switch closed state.

FIG. 6 illustrates a switch apparatus 54*a* very similar to the apparatus 54, and accordingly identical components are identically numbered, with the FIG. 6 component reference numbers including the subscript "a." The only differences in the assembly 54*a* are that the switch 62*a* is reversed, and the biasing element 69*a* is positioned on the housing 66*a* at a position remote from disk 68*a*. It will be appreciated that the apparatus 54*a* operates identically to the apparatus 10 insofar as the switch states are concerned. In both of these embodiments, when the door 14 is closed, the switches 28 and 62*a* assume a switch state wherein the spherical ball 42 or 72*a* are in simultaneous contact with the switch elements; and when the door 14 is opened, the switch states are changed. It will further be appreciated that the anti-defeat operation of the switch apparatus 54*a* is identical to that of the apparatus 54.

While the first switch state has been described herein as a state where the shiftable balls 42, 72, and 72*a* are in simultaneous contact with the switch elements, and conversely the second switch state is described where the balls are out of such simultaneous contact, it will be appreciated that such designations are for convenience only, and that such designations could be reversed if desired.

Also, while the switch apparatuses hereof have been described in the context of doors and door frames, the invention could equally be used with any system utilizing relatively shiftable members, such as windows and window frames.

I claim:

1. Magnetic switch apparatus for detecting relative movement between first and second members from a close position wherein the members are proximal, and an open position where the members are separated, said apparatus comprising:

a switch assembly for mounting on one of said members including— a housing configured and presenting a central axis and having first and second, spaced apart, electrically conductive switch elements;

a shiftable, electrically conductive body within said housing and movable between a first switch state wherein said body is in simultaneous contact with said first and second switch elements, and a second switch state wherein said body is not in simultaneous contact with said first and second switch elements;

a biasing member proximal to said housing, said biasing member and said body being magnetically correlated such that when the first and second members are in said open position, said biasing member magnetically maintains said body in one of said switch states; and an operating magnet configured for mounting on the other of said members, said operating magnet and said switch assembly being magnetically correlated such that when said first and second members are in said close position, said operating magnet magnetically maintains said body in the other of said switch states against the magnetic correlation between said body and said biasing means, said switch assembly housing being oriented with the central axis thereof at an oblique angle relative to the horizontal so that, if a defeat magnet is placed adjacent said switch assembly when the first and second members are in said close position, said defeat magnet will magnetically move said body to said one switch state notwithstanding the close position of said first and second members.

2. The switch apparatus of claim 1, said shiftable body being a magnet, and said biasing member being ferromagnetic.

3. The switch apparatus of claim 1, said shiftable body being spherical.

4. The switch apparatus of claim 1, said first switch element being elongated and extending into said housing, said housing serving as said switch element.

5. The switch apparatus of claim 1, said first member being a door frame, and said second member being a door.

6. The switch apparatus of claim 1, said central axis lying at an angle of from about 15-80°.

7. The switch apparatus of claim 1, said biasing member being spaced from said housing.

8. The switch apparatus of claim 1, said biasing member being a part of said housing.

9. The switch apparatus of claim 1, said switch assembly located within a first enclosure secured to said first member, and said operating magnet located within a second enclosure secured to said second member, said first and second enclosures being proximal when said first and second members are in said close position.

10. The switch apparatus of claim 9, said first enclosure having an inner wall and an outer wall, said inner wall adjacent said first member and said outer wall spaced from said inner wall and said first member, said switch assembly oriented such that said biasing member is closer to said outer wall than to said inner wall.

11. The switch apparatus of claim 9, said first enclosure filled with potting material surrounding said switch assembly.

12. The switch apparatus of claim 1, including electrical leads extending from said first and second switch elements and operable to be coupled with an alarm.

13. The switch apparatus of claim 1, said housing being elongated such that the longitudinal axis thereof is coincident with said central axis.

14. The switch apparatus of claim 13, said housing being closed.

15. The switch apparatus of claim 1, said first switch position being a switch closed position, and said second switch position being a switch open position.

16. Magnetic switch apparatus for detecting relative movement between first and second members from a close position wherein the members are proximal, and an open position where the members are separated, said apparatus comprising:

a switch assembly for mounting on one of said members including— a housing having first and second, spaced apart, electrically conductive switch elements;

a shiftable, electrically conductive body within said housing and movable between a first switch state wherein said body is in simultaneous contact with said first and second switch elements, and a second switch state wherein said body is not in simultaneous contact with said first and second switch elements;

a biasing member proximal to said housing, said biasing member and said body being magnetically correlated such that when the first and second members are in said open position, said biasing member magnetically maintains said body in one of said switch states; and an operating magnet configured for mounting on the other of said members, said operating magnet and said switch assembly being magnetically correlated such that when said first and second members are in said close position, said operating magnet magnetically maintains said body in the other of said switch states against the magnetic correlation between said body and said biasing means, said switch assembly housing configured and oriented so that said body traverses a path of travel between said first and second switch states which is oblique relative to the horizontal so that, if a defeat magnet is placed adjacent said switch assembly when the first and second members are in said close position, said defeat magnet will magnetically move said body to said one switch state notwithstanding the close position of said first and second members.

17. The switch apparatus of claim 16, said housing being elongated and having a central axis, said housing central axis oriented at said oblique angle.

18. The switch apparatus of claim 16, said body being a magnetic spherical ball, and said biasing member being formed of a ferromagnetic material.

* * * * *